US006783116B2

(12) United States Patent
Albritton

(10) Patent No.: US 6,783,116 B2
(45) Date of Patent: Aug. 31, 2004

(54) GUARDRAIL END TERMINAL ASSEMBLY HAVING AT LEAST ONE ANGLE STRUT

(75) Inventor: James R. Albritton, Aledo, TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/862,831

(22) Filed: May 21, 2001

(65) Prior Publication Data

US 2002/0024043 A1 Feb. 28, 2002

Related U.S. Application Data

(63) Continuation-in-part of application No. 09/358,017, filed on Jul. 19, 1999, now Pat. No. 6,398,192.

(60) Provisional application No. 60/206,052, filed on May 22, 2000, and provisional application No. 60/115,122, filed on Jan. 6, 1999.

(51) Int. Cl.[7] ..... E01F 15/04

(52) U.S. Cl. ..... 256/13.1; 256/31

(58) Field of Search ..... 404/6, 9; 256/13.1, 256/31, 65.03

(56) References Cited

U.S. PATENT DOCUMENTS

| | | | |
|---|---|---|---|
| 79,141 A | 6/1868 | McFarlin | |
| 398,078 A | 2/1889 | Peterson | |
| 446,852 A | 2/1891 | Davis | |

(List continued on next page.)

FOREIGN PATENT DOCUMENTS

| | | | |
|---|---|---|---|
| AT | 278890 | 2/1970 | ..... E01F/15/00 |
| AU | A-21844/88 | 11/1990 | ..... E01F/13/00 |
| CA | 2167548 A * | 7/1996 | ..... E01F/15/00 |
| DE | 1 916 361 | 5/1965 | |
| DE | 1534526 | 11/1965 | |
| DE | 278890 | 4/1967 | ..... E01F/15/00 |
| DE | 3708861 | 10/1988 | ..... E01F/15/00 |
| EP | 0245042 | 4/1987 | ..... E01F/15/00 |
| FR | 2 386 667 | 4/1977 | ..... E04H/12/22 |
| FR | 2546932 | 6/1983 | ..... E01F/15/00 |
| GB | 2023695 A | 1/1980 | |
| JP | 10-18255 * | 1/1988 | |
| LU | 40465 | 10/1961 | |
| LU | 41444 | 5/1962 | |
| LU | 41444 A | 5/1962 | |
| WO | 98/50637 | 12/1998 | ..... E01F/15/04 |
| WO | 00/40805 | 7/2000 | ..... E01F/15/04 |

OTHER PUBLICATIONS

International Preliminary Examination Report for pending PCT Patent Application No. PCT/US99/30463, Mar. 21, 2001.

ET–2000 The Future of Highway Safety—SYRO (Printed in Dec. 1990; revised Oct. 1992), Oct. 1992.

International Search Report for PCT/US99/30463, Apr. 28, 2000.

International Search Report for PCT/US98/09029, Sep. 1, 1998.

*Breakaway Metal Post for Highway Guardrail End Treatments* Patent ApplicationUSSN 09/074,496 filed May 7, 1998 James R. Albritton (091078.0554).

U.S. patent application publication No. US 2001/0013596 dated Aug. 16, 2001 for U.S. patent application Ser. No. 09/410,635 filed Oct. 1, 1999 by Dean L. Sicking et al.

(List continued on next page.)

*Primary Examiner*—James R. Brittain
(74) *Attorney, Agent, or Firm*—Baker Botts L.L.P.

(57) ABSTRACT

A highway guardrail system is provided with an end terminal assembly mounted on a pair of support posts. Portions of the guardrail are attached to the support posts, the end terminal assembly preferably includes a kinetic energy absorbing assembly that dissipates energy from an impacting vehicle. An angle strut having a generally L-shaped cross section may be attached to the first support post and the second support post.

20 Claims, 6 Drawing Sheets

U.S. PATENT DOCUMENTS

| | | | | | |
|---|---|---|---|---|---|
| 629,185 | A | | 7/1899 | Arnold | |
| 1,335,502 | A | | 3/1920 | Stout | |
| 1,473,118 | A | | 11/1923 | Miller-Masury | |
| 1,677,796 | A | | 7/1928 | Parks | 248/548 |
| 2,089,929 | A | | 8/1937 | Brickman et al. | 256/13.1 |
| 2,091,195 | A | | 8/1937 | Dennebaum | 267/69 |
| 2,123,167 | A | * | 7/1938 | Cain | 256/13.1 |
| 2,135,705 | A | | 11/1938 | Florance | 256/13.1 |
| 2,146,445 | A | | 2/1939 | Russert et al. | 169/29 |
| 2,309,238 | A | | 1/1943 | Corey | 287/99 X |
| 2,735,251 | A | | 2/1956 | Dlugosch | 55/159 |
| 2,776,116 | A | | 1/1957 | Brickman | 256/13.1 |
| 3,308,584 | A | | 3/1967 | Graham | 52/98 X |
| 3,332,666 | A | | 7/1967 | Gray | 256/13.1 |
| 3,349,531 | A | | 10/1967 | Watson | 52/296 X |
| 3,385,564 | A | | 5/1968 | Persicke | 256/13.1 |
| 3,417,965 | A | | 12/1968 | Gray | 256/13.1 |
| 3,450,233 | A | | 6/1969 | Massa | 188/1 |
| 3,499,630 | A | | 3/1970 | Dashio | 256/13.1 |
| 3,519,301 | A | | 7/1970 | Somnitz | 293/1 |
| 3,521,917 | A | | 7/1970 | King | 287/111 X |
| 3,567,184 | A | | 3/1971 | Yancey | 256/13.1 |
| 3,606,222 | A | | 9/1971 | Howard | 52/98 X |
| 3,617,076 | A | | 11/1971 | Attwood et al. | 256/13.1 |
| 3,637,244 | A | | 1/1972 | Strizki | 287/129 |
| 3,643,924 | A | | 2/1972 | Fitch | 256/13.1 |
| 3,680,448 | A | | 8/1972 | Ballingall et al. | 52/169.12 |
| 3,693,940 | A | | 9/1972 | Kendall et al. | 256/1 |
| 3,711,881 | A | * | 1/1973 | Chapman et al. | 135/87 |
| 3,768,781 | A | | 10/1973 | Walker et al. | 256/1 |
| 3,776,520 | A | | 12/1973 | Charles et al. | 256/13.1 |
| 3,820,906 | A | | 6/1974 | Katt | 403/2 |
| 3,846,030 | A | | 11/1974 | Katt | 403/2 |
| 3,912,404 | A | | 10/1975 | Katt | 403/2 |
| 3,925,929 | A | | 12/1975 | Montgomery | 49/404 |
| 3,951,556 | A | | 4/1976 | Strizki | 403/2 |
| 3,967,906 | A | | 7/1976 | Strizki | 403/2 |
| 3,981,486 | A | | 9/1976 | Baumann | 256/13.1 |
| 4,063,713 | A | | 12/1977 | Anolick et al. | 256/13.1 |
| 4,071,970 | A | | 2/1978 | Strizki | 40/607 |
| 4,126,403 | A | | 11/1978 | Sweeney et al. | 403/2 |
| 4,183,695 | A | | 1/1980 | Wilcox | 404/256 |
| 4,236,843 | A | | 12/1980 | Chisholm | 403/2 |
| 4,269,384 | A | | 5/1981 | Saeed et al. | 248/548 |
| 4,278,228 | A | | 7/1981 | Rebentisch et al. | 248/548 |
| 4,295,637 | A | | 10/1981 | Hulek | 256/13.1 |
| 4,330,106 | A | | 5/1982 | Chisolm | 256/13.1 |
| 4,389,134 | A | | 6/1983 | Colas | 403/263 |
| 4,399,980 | A | | 8/1983 | van Schie | 256/13.1 |
| 4,490,062 | A | | 12/1984 | Chisholm | 403/2 |
| 4,583,716 | A | | 4/1986 | Stephens et al. | 256/13.1 |
| 4,607,824 | A | | 8/1986 | Krage et al. | 256/13.1 |
| 4,646,489 | A | | 3/1987 | Feller et al. | 52/165 |
| 4,655,434 | A | | 4/1987 | Bronstad | 256/13.1 |
| 4,678,166 | A | | 7/1987 | Bronstad et al. | 256/13.1 |
| 4,729,690 | A | | 3/1988 | Lavender et al. | 404/10 |
| 4,784,515 | A | | 11/1988 | Krage et al. | 404/6 |
| 4,815,565 | A | | 3/1989 | Sicking et al. | 188/32 |
| 4,838,523 | A | | 6/1989 | Humble et al. | 256/13.1 |
| 4,852,847 | A | | 8/1989 | Pagel | 248/548 |
| 4,923,319 | A | | 5/1990 | Dent | 403/2 |
| 4,926,592 | A | | 5/1990 | Nehls | 52/98 |
| 4,928,446 | A | | 5/1990 | Alexander, Sr. | 42/98 |
| 4,928,928 | A | | 5/1990 | Buth et al. | 256/13.1 |
| 4,986,687 | A | | 1/1991 | Ivey | 403/2 |
| 5,022,782 | A | | 6/1991 | Gertz et al. | 404/6 |
| 5,078,366 | A | | 1/1992 | Sicking et al. | 256/13.1 |
| 5,203,543 | A | | 4/1993 | Fleury | 256/13.1 |
| 5,214,886 | A | | 6/1993 | Hugron | 52/248 |
| 5,286,137 | A | | 2/1994 | Cincinnati et al. | 404/6 |
| 5,391,016 | A | | 2/1995 | Ivey et al. | 404/6 |
| 5,407,298 | A | | 4/1995 | Sicking et al. | 404/6 |
| 5,484,217 | A | | 1/1996 | Carroll et al. | 403/2 |
| 5,503,495 | A | | 4/1996 | Mak et al. | 404/6 |
| 5,547,309 | A | | 8/1996 | Mak et al. | 404/6 |
| 5,595,470 | A | * | 1/1997 | Berkey et al. | 414/495 |
| 5,657,966 | A | | 8/1997 | Cicinnati | 256/13.1 |
| 5,664,905 | A | | 9/1997 | Thompson et al. | 256/13.1 X |
| 5,775,675 | A | | 7/1998 | Sicking et al. | 256/13.1 |
| 5,797,591 | A | | 8/1998 | Krage | 256/13.1 |
| 5,924,680 | A | | 7/1999 | Sicking et al. | 256/13.1 |
| 5,931,448 | A | | 8/1999 | Sicking et al. | 256/13.1 |
| 5,957,435 | A | | 9/1999 | Bronstad | 256/13.1 |
| 5,988,598 | A | | 11/1999 | Sicking et al. | 256/13.1 |
| 6,022,003 | A | | 2/2000 | Sicking et al. | 256/13.1 |
| 6,065,894 | A | | 5/2000 | Wasson et al. | 403/2 |
| 6,109,597 | A | | 8/2000 | Sicking et al. | 256/13.1 |
| 6,129,342 | A | | 10/2000 | Bronstad | 256/13.1 |
| 6,210,066 | B1 | | 4/2001 | Dent | 403/2 |
| 6,220,575 | B1 | * | 4/2001 | Lindsay et al. | |
| 6,244,571 | B1 | | 6/2001 | Reid et al. | 256/13.1 |
| 6,254,063 | B1 | | 7/2001 | Rohde et al. | 256/13.1 |
| 6,260,827 | B1 | | 7/2001 | Sicking et al. | 256/13.1 |
| 6,308,809 | B1 | | 10/2001 | Reid et al. | 188/377 |
| 6,409,156 | B2 | | 6/2002 | Dent | 256/13.1 |
| 6,416,041 | B1 | | 7/2002 | Sicking et al. | 256/13.1 |
| 6,488,268 | B1 | | 12/2002 | Albritton | 256/13.1 |
| 6,583,363 | B1 | | 6/2003 | Wilson, Jr. | 174/158 |
| 6,644,888 | B2 | | 11/2003 | Ochoa | 404/6 |

OTHER PUBLICATIONS

U.S. patent application publication No. US 2002/0007994 dated Jan. 24, 2002 for U.S. patent application Ser. No. 09/935,949 filed Aug. 23, 2001 by John D. Reid et al. Assigned to Safety By Design Company.

Bronstad et al., *Modified Breakaway Cable Terminals for Guardrails and Median Barriers*, Research Results Digest, NCHRP, Transportation Research Board; Digest 12, May 1978.

* cited by examiner

GUARDRAIL END TERMINAL ASSEMBLY HAVING AT LEAST ONE ANGLE STRUT

RELATED APPLICATION

This application is a continuation-in-part application of application Ser. No. 09/358,017 filed Jul. 19, 1999 entitled Breakaway Support Posts for Highway Guardrail End Terminals which claims the priority under 35 U.S.C. §119 from provisional application No. 60/115,122 filed Jan. 6, 1999; now U.S. Pat. No. 6,398,192.

This application is related to application Ser. No. 08/375,395 filed Jan. 18, 1995 entitled Anchor Assembly For Highway Guardrail End Terminal now U.S. Pat. No 6,220,575.

This application claims the benefit of provisional application serial No. 60/206,052 filed May 22, 2000 entitled—Guardrail End Terminal Assembly Having At Least One Angle Strut.

TECHNICAL FIELD OF THE INVENTION

The present invention relates to highway guardrail systems having a guardrail mounted on posts, and more particularly, to guardrail end terminals having at least two posts with a strut extending therebetween and the end terminals designed to meet applicable federal and state safety standards including but not limited to crash worthiness requirements.

BACKGROUND OF THE INVENTION

Along most highways there are hazards which present substantial danger to drivers and passengers of vehicles if the vehicles leave the highway. To prevent accidents from a vehicle leaving a highway, guardrail systems are often provided along the side of the highway. Experience has shown that guardrails should be installed such that the end of a guardrail facing oncoming traffic does not present another hazard more dangerous than the original hazard requiring installation of the associated guardrail systems. Early guardrail systems often had no protection at the end facing oncoming traffic. Sometimes impacting vehicles became impaled on the end of the guardrail causing extensive damage to the vehicle and severe injury to the drivers and/or passengers. In some reported cases, the guardrail penetrated directly into the passenger's compartment of the vehicle fatally injuring the driver and passengers.

Various highway guardrail systems and guardrail end terminals have been developed to minimize the consequences resulting from a head-on impact between a vehicle and the extreme end of the associated guardrail. One example of such end terminals includes tapering the ends of the associated guardrail into the ground to eliminate potential impact with the extreme end of the guardrail. Other types of end terminals include breakaway cable terminals (BCT), vehicle attenuating terminals (VAT), the SENTRE end terminal, and breakaway end terminals (BET).

It is desirable for an end terminal assembly installed at one end of a guardrail facing oncoming traffic to attenuate any head-on impact with the end of the guardrail and to provide an effective anchor to redirect a vehicle back onto the associated roadway after a rail face impact with the guardrail downstream from the end terminal assembly. Examples of such end terminals are shown in U.S. Pat. No. 4,928,928 entitled Guardrail Extruder Terminal, and U.S. Pat. No. 5,078,366 entitled Guardrail Extruder Terminal.

A SENTRE end terminal often includes a series of breakaway steel guardrail support posts and frangible plastic containers filled with sandbags. An impacting vehicle is decelerated as the guardrail support posts release or shear and the plastic containers and sandbags are compacted. A cable is often included to guide an impacting vehicle away from the associated guardrail.

Wooden breakaway support posts are frequently used to releasably anchor guardrail end terminals and portions of the associated guardrail. Such wooden breakaway support posts, when properly installed, generally perform satisfactorily to minimize damage to an impacting vehicle during either a rail face impact or a head-on impact. However, impact of a vehicle with a wooden breakaway support post may often result in substantial damage to the adjacent soil. Removing portions of a broken wooden post from the soil is often both time consuming and further damages the soil. Therefore, wooden breakaway support posts are often installed in hollow metal tubes, sometimes referred to as foundation sleeves, and/or concrete foundations. For some applications, one or more soil plates may be attached to each hollow tube or foundation sleeve to further improve breakaway characteristics of the associated wooden post. Struts are particularly helpful in maintaining the hollow tubes or foundation sleeves securely positioned adjacent to the roadway during vehicle impact with the associated guardrail. Also, various types of struts have between disposed between and coupled with the associated wooden posts to improve the breakaway characteristics.

SUMMARY OF THE INVENTION

From the foregoing, it may be appreciated that a need exists to provide improved support for breakaway support posts associated with guardrail end terminals. According to one embodiment of the present invention, this need is met by an angle strut extending between and coupled with a first hollow tube and a second hollow tube, both of which may be inserted into the soil adjacent to a roadway. Respective support posts may be inserted into the hollow tubes and coupled with the angle strut. For some applications, more than one angle strut may be installed between a first support post and a second support post.

Each support post will generally resist a rail face impact with the guardrail (strong direction). An impact with one end of the attached guardrail (weak direction) will tend to rotate and/or break the support posts proximate the associated hollow tube. Each support post preferably exhibits a high mechanical strength in the strong direction and lower mechanical strength in the weak direction. Generally, the strong direction and the weak direction for each support post are approximately perpendicular relative to each other. Placing an angle strut between the first support post and the second support post of a guardrail end terminal in accordance with teachings of the present invention provides desired support for an associated cable anchor assembly. The angle strut also provides additional support to ensure failure of the associated support posts at a desired location immediately above the respective hollow tubes to help maintain the hollow tubes securely positioned adjacent to the roadway. As a result overall cost of maintenance and repair of an associated guardrail end terminal assembly following a crash event may be substantially reduced.

The present invention provides an angle strut which substantially reduces manufacturing and assembly costs for an associated guardrail end terminal assembly, while at the same time allowing the guardrail end terminal assembly to effectively anchor the guardrail during a downstream side-face impact and to function satisfactorily during a head-on impact with one end of the guardrail without excessive damage to the impacting vehicle. An angle strut incorporating teachings of the present invention may be disposed between a first support post and a second support post having either right or left lateral offset relative to the guardrail.

An end terminal assembly is often provided at one end of a guardrail facing oncoming traffic to substantially enhance the safety of a vehicle impacting at or near the end of the guardrail. An end terminal assembly incorporating teachings of the present invention may be used with a guardrail mounted on a plurality of breakaway support posts made from wood or other suitable materials. A first post is preferably provided adjacent to an extreme end of the guardrail. A second post may be spaced longitudinally from the first post with an angle strut extending therebetween. For some applications the first and second posts may be aligned substantially parallel with each other and the guardrail. For other applications the second post may be spaced longitudinally from the first post and offset laterally from the guardrail. The end terminal assembly may include a kinetic energy absorbing assembly such as an extruder terminal that dissipates energy from an impacting vehicle by squeezing a W-beam guardrail into a relatively flat plate and bending the flattened guardrail in an arc directed away from the impacting vehicle. Other types of kinetic energy absorbing assemblies may be satisfactorily used with an end terminal assembly having at least one angle strut incorporating teachings of the present invention. Alternatively, an angle strut incorporating teachings of the present invention may be satisfactorily used with an end terminal assembly which does not include a kinetic energy absorbing assembly.

Technical advantages of the present invention include providing an end terminal assembly for a highway guardrail system which is less expensive to manufacture than prior designs and which is easier to install. An angle strut incorporating teachings of the present invention may be fabricated from a single piece of commercially available angle or other suitable types of construction and structural materials. Prior to the present invention, separate right hand struts and left hand struts were sometimes required depending upon the direction of the lateral offset of the second support post from the associated guardrail. An angle strut incorporating teachings of the present invention may be used with either a right offset or a left offset.

BRIEF DESCRIPTION OF THE DRAWINGS

For a more complete understanding of the present invention, and the advantages thereof, reference is now made to the following written description taken in conjunction with the accompanying drawings, in which.

DETAILED DESCRIPTION OF THE INVENTION

Figures 1, 2:
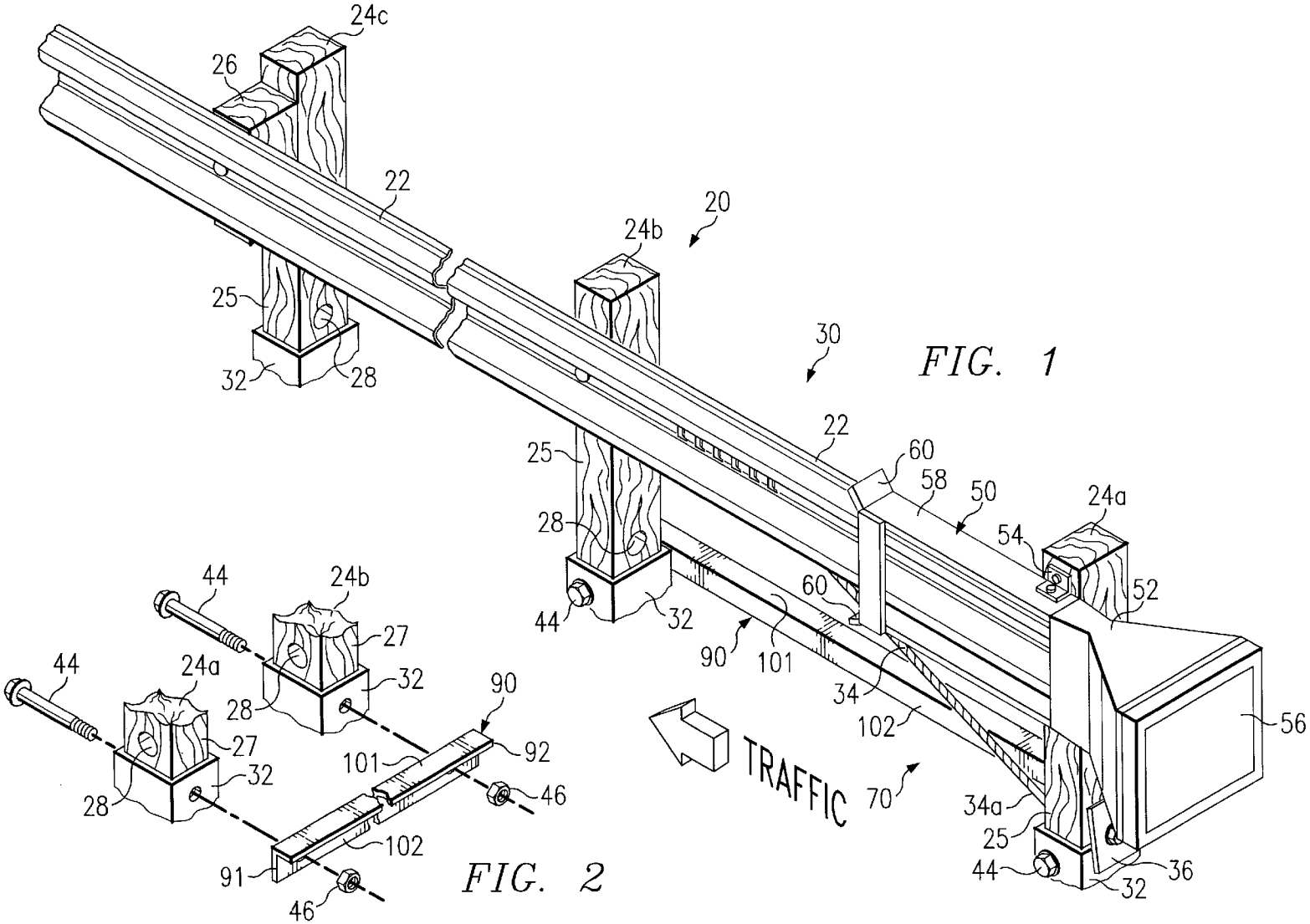
FIG. 1 is an isometric drawing with portions broken away showing a highway guardrail system having an end terminal assembly with an angle strut incorporating teachings of the present invention.
FIG. 2 is an isometric drawing with portions broken away showing the first support post, the second support post, the angle strut and mechanical fasteners associated with the end terminal assembly of FIG. 1.
Figure 3:
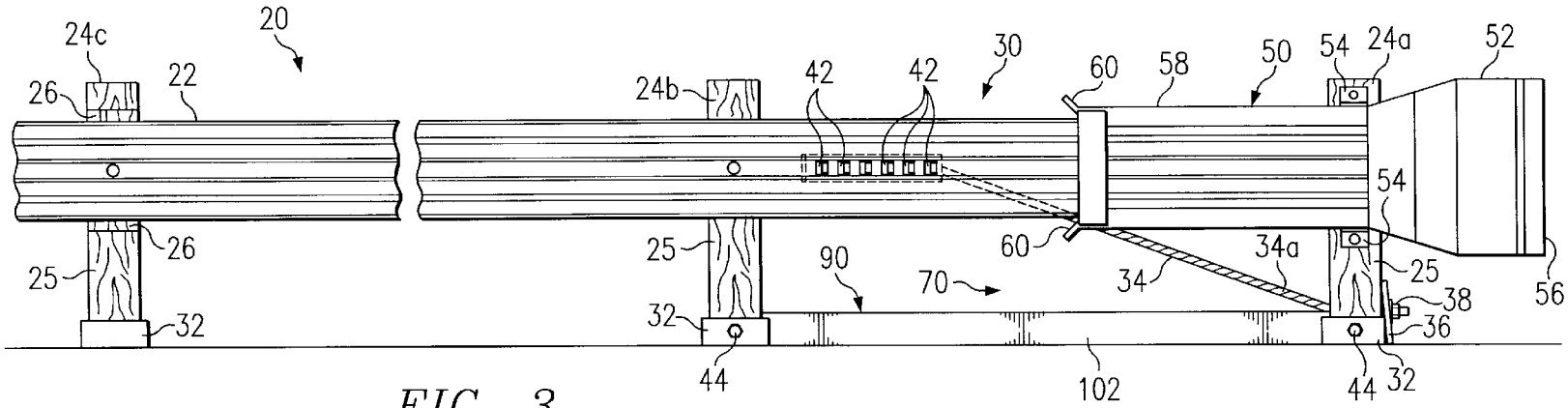
FIG. 3 is a side view with portions broken away of the guardrail system shown in FIG. 1.
Figure 4:
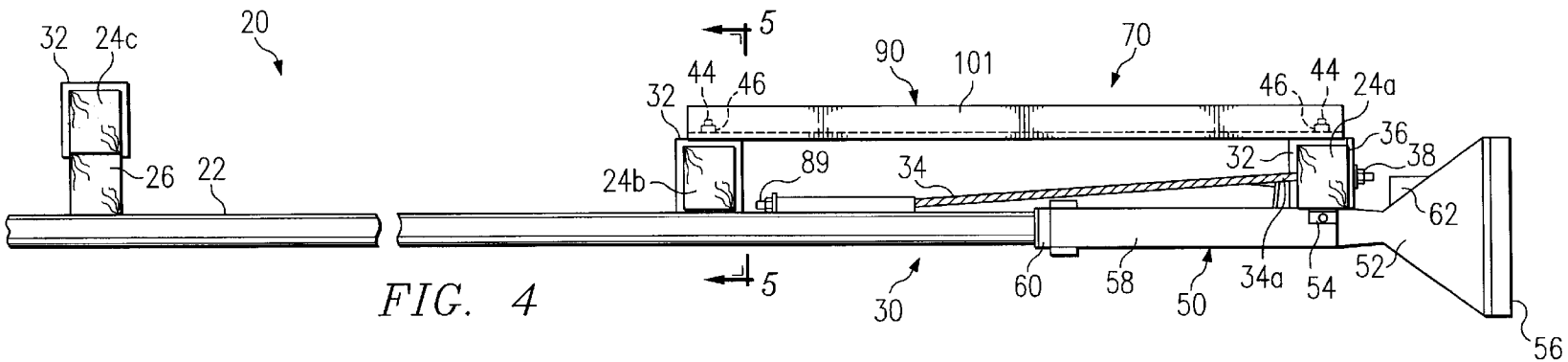
FIG. 4 is a top plan view with portions broken away of the guardrail system shown in FIG. 1.

Preferred embodiments of the present invention and its advantages are best understood by referring now in more detail to FIGS. 1–13 of the drawings, in which like numerals refer to like parts.

Guardrail system 20 with end terminal assembly 30 incorporating teachings of the present invention is shown generally in FIGS. 1–5. Guardrail system 20 will typically be installed along the side of a highway or roadway (not expressly shown) adjacent to a hazard (not expressly shown) to prevent a vehicle (not expressly shown) from leaving the highway. Guardrail system 20 preferably includes guardrail 22 mounted on a plurality of posts 24. In FIGS. 1–4, only posts 24*a*, 24*b* and 24*c* are shown. However, the number of posts and the length of guardrail 22 depends upon the length and other characteristics associated with the hazard adjacent to the highway or roadway requiring installation of guardrail system 20.

Guardrail system 20 is shown with a typical deep W-beam twelve (12) gauge type guardrail 22. For some applications, a thrie beam guardrail may be satisfactorily used. Other types of guardrails, both folded and non-folded, may be satisfactorily used with angle struts incorporating teachings of the present invention. For some applications when guardrail system 20 and guardrail end terminal assembly 30 are installed along the edge of a highway, a taper of approximately fifty to one is recommended so that portions of guardrail end terminal assembly 30 such as kinetic energy absorbing assembly 50 will not encroach upon the shoulder of the highway.

Guardrail system 20 is primarily designed and installed along a highway to withstand a rail face impact from a vehicle downstream from an associated guardrail end terminal assembly. Various types of end terminal assemblies and energy absorbing devices may be provided at the end of guardrail 22 facing oncoming traffic. Examples of end terminal assemblies satisfactory for use with the present invention are shown in U.S. Pat. No. 4,655,434 entitled Energy Absorbing Guardrail Terminal; U.S. Pat. No. 4,928,928 entitled Guardrail Extruder Terminal; and U.S. Pat. No. 5,078,366 entitled Guardrail Extruder Terminal. Such end terminal assemblies extend substantially parallel with the associated highway or roadway. U.S. Pat. No. 4,678,166 entitled Eccentric Loader Guardrail Terminal shows an end terminal assembly which flares away from the associated roadway. When this type of end terminal assembly is hit by a vehicle, the guardrail will normally release from the associated support posts and allow the impacting vehicle to pass behind downstream portions of the associated guardrail. However, an angle strut and support posts incorporating teachings of the present invention may be used with any guardrail end terminal assembly or guardrail system having satisfactory energy-absorbing characteristics for the associated roadway and anticipated vehicle traffic.

Support posts 24 may be fabricated from wood, various types of steel alloys or other materials with the desired strength and/or breakaway characteristics appropriate for the respective highway guardrail system 20. For some applications, support posts 24 may be fabricated from ceramic materials or a mixture of ceramic and metal alloys which are sometimes referred to as cermets. The type of materials which may be satisfactorily used to manufacture support posts 24 with the desired strength and/or breakaway characteristics appropriate for the specific guardrail system, location of each post and roadside hazard include, but are not limited to, wood, steel, composite materials and various types of plastics. Various features of the present invention will be described with respect to support posts having a generally square cross section. However, an angle strut incorporating teachings of the present invention may be used with support posts having a circular or any other cross section.

Angle struts incorporating teachings of the present invention may be used with hinged breakaway posts (not expressly shown) and a wide variety of other types of breakaway posts (not expressly shown) satisfactory for use with an associated guardrail system. Examples of breakaway support posts which may be used with angle struts in accordance with teachings of the present invention are shown in patent application Ser. No. 09/358,017 filed Jul. 19, 1999 entitled Breakaway Support Post for Highway Guardrail End Treatments now U.S. Pat. No. 6,398,192 and pending patent application Ser. No. 09/074,496 filed May 7, 1998 entitled Breakaway Support Post for Highway Guardrail End Treatments.

For guardrail system 20, a plurality of hollow tubes 32 may be placed in the ground adjacent to a shoulder of an associated highway at the desired location for end terminal assembly 30. Hollow tubes 32 may sometimes be referred to as "foundation tubes" or "foundation sleeves." Hollow tubes 32 may be formed from steel alloys or other suitable materials satisfactory for use in construction of guardrail system 20. The configuration and dimensions of support posts 24 and hollow tubes 32 are selected so that support posts 24 may be inserted into respective foundation tubes 32. In addition to foundation tubes 32, other types of posts-to-ground installation systems such as concrete with steel slip base posts and direct drive breakaway posts may be satisfactorily used with a guardrail end terminal assembly and angle strut incorporating teachings of the present invention.

Various techniques which are well known in the highway construction industry may be satisfactorily used to install foundation tubes 32 and support posts 24 depending upon the type of soil conditions and other factors associated with the adjacent highway and hazard requiring installation of guardrail system 20. For many applications, support posts 24 may be simply driven into the soil using an appropriately sized hydraulic and/or pneumatic driver. As a result, support posts 24 may be easily removed from the soil using an appropriately sized crane or other type of pulling tool. U.S. Pat. No. 5,503,495, entitled Thrie-Beam Terminal With Breakaway Post Cable Release, shows one example of a breakaway support post with this type of foundation.

Support posts 24*a*, 24*b* and 24*c* have a strong direction oriented generally perpendicular to guardrail 22. When subjected to an impact from the strong direction (rail face impact), support posts 24*a*, 24*b* and 24*c* exhibit a generally high mechanical strength. During a rail face impact, support posts 24*a*, 24*b* and 24*c* will often remain intact to direct an impacting vehicle (not expressly shown) back onto the associated roadway.

Figure 5:
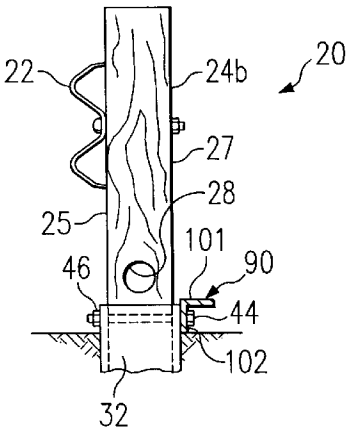
FIG. 5 is a schematic drawing in section and in elevation with portions broken away taken along line 5—5 of FIG. 4.

Support posts 24*a*, 24*b* and 24*c* have a weak direction which is oriented generally parallel with guardrail 22. As shown in FIGS. 1, 2 and 5, respective holes 28 are preferably formed in each post 24*a*, 24*b*, 24*c* and any other support post associated with guardrail end terminal assembly 30 to help provide desired breakaway characteristics during impact between a vehicle and the end of guardrail 22. Holes 28 in posts 24*a*, 24*b* and 24*c* should be aligned generally parallel with the associated roadway. Foundation tubes 32 cooperate with holes 28 to establish generally uniform breakaway characteristics for respective support posts 24*a*, 24*b* and 24*c*.

When support posts 24*a*, 24*b* and 24*c* are subjected to an impact from the weak direction (such as when a vehicle impacts the end of guardrail 22) support posts 24*a*, 24*b* and 24*c* exhibit relatively low mechanical strength. The upper portion of each support post 24*a*, 24*b* and 24*c*, which is disposed substantially above its respective foundation tube 32, will preferably yield to avoid presenting a barrier to an impacting vehicle. The upper portion of each support post 24*a*, 24*b* and 24*c* will preferably deflect and/or breakaway to minimize lifting of the impacting vehicle into the air.

Guardrail 22 is connected to first side 25 of first support post 24*a* adjacent to the end of guardrail 22 facing oncoming traffic. Guardrail 22 is also connected first side 25 of second support post 24*b* spaced longitudinally from first support post 24. As discussed later in more detail, one or more blocks may be disposed between support posts 24 and guardrail 22. For purposes of explaining various features of the present invention, support posts 24 will be described with respect to first side 25 disposed adjacent to an associated roadway and second side 27 disposed opposite from the associated roadway. See FIGS. 5 and 8. When an angle strut is used in accordance with teachings of the present invention with a support post having a circular cross section, "first side" would correspond with a portion of the support post closest to the associated roadway. "Second side" would correspond with a portion of the support post opposite from or furthest from the associated roadway.

Anchor assembly 70 including cable 34, cable anchor bracket 71, and angle strut 90 are preferably included as a part of guardrail end terminal assembly 30 to provide the desired amount of tension, anchoring and support for guardrail 22 during a rail face impact from a vehicle collision downstream from kinetic energy absorbing assembly 50. Cable 34 is preferably a breakaway type cable associated with highway guardrail systems and is selected to provide the desired tension strength for guardrail 22 during such a rail face impact.

First portion 34*a* of cable 34 is preferably secured with first post 24*a* using plate 36 and nut 38. Second portion 34*b* at the opposite end of cable 34 is preferably secured to cable anchor bracket 71. A plurality of tabs 68 extend outwardly at an acute angle from cable anchor bracket 71 to releasably anchor second portion 34*b* of cable 34 with a plurality of apertures 42 formed in guardrail 22 between first post 24*a* and second post 24*b*.

Angle strut 90 is preferably installed between and connected to first support post 24*a*, second support post 24*b* and respective hollow tubes 32 to provide additional structural support for cable 34 and guardrail 22 during downstream rail face impacts. Angle strut 90 transfers loads from a rail face or redirective impact. Angle strut 90 may be generally described as a compression load transferring member used to transfer tension normally associated with cable anchor assembly 70 from first support post 24*a* to second support post 24*b* by compressive forces applied thereto. As discussed later in more detail, support posts 24*a* and 24*b* will preferably break when a vehicle impacts the end of guardrail 22.

For purposes of illustrating some of the features of the present invention, end terminal assembly 30 is shown in conjunction with guardrail 22 having a typical W-beam configuration with kinetic energy absorbing assembly 50 disposed on the end of guardrail 22 adjacent to first post 24*a* facing oncoming traffic. In the event of a collision between a vehicle and the end of guardrail 22, kinetic energy absorbing assembly 50 is provided to dissipate the impact energy of the vehicle without creating a dangerous condition.

Extruder terminal 52 has been described as first flattening guardrail 22 and then bending it in an arc away from the direction of travel of the impacting vehicle. It should be understood, however, that various kinetic energy absorbing assemblies which may or may not flatten guardrail 22 can be satisfactorily used with an angle strut incorporating techniques of the present invention. One or more brackets 54 are provided to releasably secure extruder terminal 52 with first post 24*a* prior to impact by a vehicle. Extruder terminal 52 includes front striking plate 56 and feeder chute 58.

During a collision, feeder chute 58 functions as a guide to direct guardrail 22 into extruder terminal 52. Feeder chute 58 also keeps extruder terminal 52 from rotating relative to guardrail 22 during an impact or collision. If extruder terminal 52 were to rotate during impact, guardrail 22 would no longer feed into extruder terminal 52 resulting in an immediate deceleration of the impacting vehicle and potentially causing a very dangerous condition. Feeder chute 58 includes guides 60 that prevent shaving of guardrail 22 by the ends of feeder chute 58 as feeder chute 58 moves down the length of guardrail 22 during a head on collision with striker plate 56. Guides 60 accommodate any irregularities or bumps in guardrail 22 to ensure proper feeding of guardrail 22 into extruder terminal 52.

During an initial impact and movement of extruder terminal 52 down the length of guardrail 22, support posts 24*a*, 24*b* and 24*c* will tend to bend or rotate and preferably break adjacent to respective hollow tubes 32. In addition to providing desired structural support as part of anchor assembly 70, angle strut 90 helps to minimize any undesired movement of hollow tubes 32 and possible bending or rotation of first support post 24*a* and second support post 24*b* during vehicle impact.

Prior to impact with a vehicle, cable 34 is taunt with first portion 34*a* secured with first post 24*a* and tabs 68 inserted into corresponding apertures 42 to releasably secure cable anchor bracket 71 with guardrail 22. Following an initial head on impact of a vehicle with striker plate 56 and the initiation of flattening and bending of guardrail 22, the impacting vehicle and extruder terminal 52 engage first post 24*a* breaking it at the top of the associated foundation tube 32. Breaking first post 24*a* will release first portion 34*a* of cable 34. As feeder chute 58 continues moving down guardrail 22 during the collision, it will engage cable anchor bracket 71. Since the tension in cable 34 has been released, engagement of feeder chute 58 with cable anchor bracket 71 moves tabs 68 out of their associated apertures 42 releasing cable anchor bracket 71 and second cable portion 34*b* from guardrail 22. Cable 34 and cable anchor bracket 71 can now move out of the path of extruder terminal 52 and avoid possibly blocking the movement of extruder terminal 52 relative to guardrail 22.

For the embodiments shown in FIGS. 1–8 and 13, angle strut 90 is preferably formed from an elongated angle or other types of structural material having a generally L shaped cross section. For some applications angle strut 90 may be fabricated from commercially available, standard, hot rolled angle having a cross section which measures approximately three inches by three inches with a thickness of approximately one-fourth of an inch. Conventional metal working techniques such as bending, roll forming, break forming and/or stamping may also be used to form angle strut 90 from a respective strip of metal or other suitable material. Substantial manufacturing cost may be saved and installation procedures simplified by forming angle strut 90 from commercially available structural materials.

An angle strut having a cross section other than three inches by three inches may be satisfactorily used with a guardrail end terminal assembly. The configuration and dimensions associated with an angle strut may be varied in accordance with teachings of the present invention depending upon the configuration of the associated guardrail end terminal assembly, and the anticipated vehicle traffic and the associated roadway. The configuration and dimension associated with angle strut 90 may be varied as desired to provide the required support for first support post 24*a*, second support post 24*b* and associated hollow tubes 32.

Angle strut 90 includes first end 91 and second end 92. An appropriately sized hole or holes (not expressly shown) are preferably formed adjacent to ends 91 and 92 for use in coupling angle strut 90 with support post 24*a*, 24*b* and their respective hollow tubes 32. Respective holes or openings are preferably formed in portions of hollow tubes 32, support post 24*a* and 24*b* and the respective holes formed in angle strut 90 adjacent to ends 91 and 92 to accommodate inserting bolt 44 therethrough. A respective nut 46 may be used to secure bolts 44 with support posts 24*a*, 24*b*, hollow tubes 32 and angle strut 90. Angle strut 90 is preferably installed immediately adjacent to the ground line facing away from the associated roadway. Bolts 44 may be formed from high strength steel with a diameter of three-fourths of an inch. In addition to bolts 44 and nuts 46, a wide variety of mechanical fasteners may be satisfactorily used with the present invention including screws, hucks and clamps.

Figure 8:
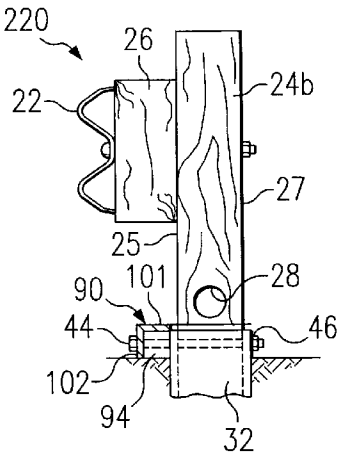
FIG. 8 is a schematic drawing in section and in elevation with portions broken away taken along line 8—8 of FIG. 7.

As shown in FIGS. 5 and 8, angle strut 90 may have a generally L-shaped cross section defined in part by first leg 101 and second leg 102. For the embodiments shown in FIGS. 1–8, first leg 101 and second leg 102 may have a width of approximately three inches and a thickness of approximately one-fourth of an inch. For some applications angle strut 90 may be formed with first leg 101 having a width larger or smaller than the width of second leg 102. Also, the thickness of first leg 101 and second leg 102 may be larger or smaller than one-fourth of an inch.

Figure 6:
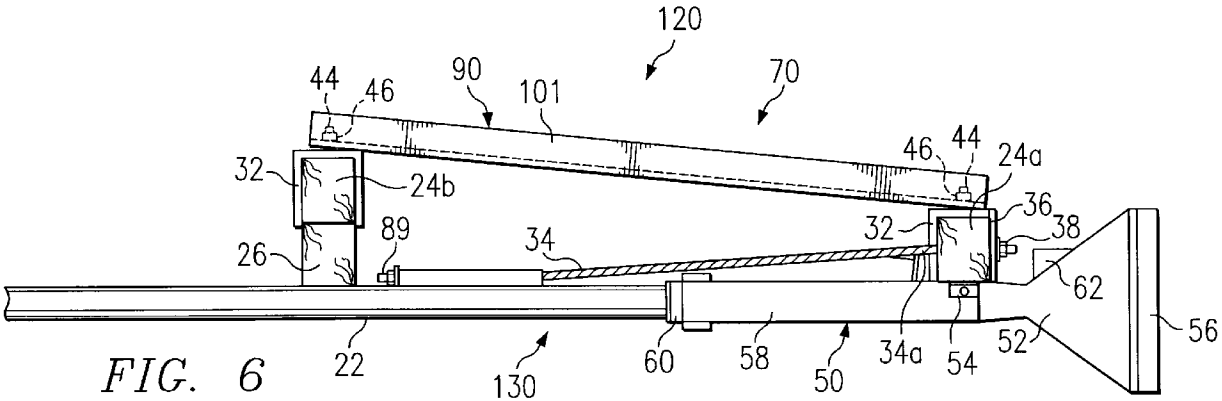
FIG. 6 is a schematic drawing showing a plan view of one configuration for an angle strut extending between a first support post and a second support post having a lateral offset with respect to an associated guardrail.
Figure 7:
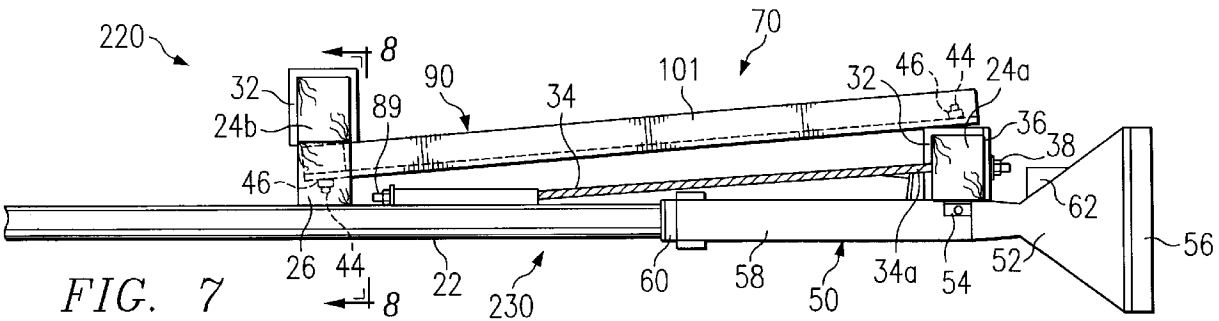
FIG. 7 is a schematic drawing showing a plan view of another configuration for an angle strut extending between a first support post and a second support post having a lateral offset with respect to an associated guardrail.

Guardrail system 120 shown in FIG. 6 and guardrail system 220 as shown in FIG. 7 are similar to previously described guardrail system 20 except for an offset between second support post 24*b* and guardrail 22 and the orientation of angle strut 90 extending between first support post 24*a* and second support post 24*b*. As previously noted, second support post 24*b* is often installed with a lateral offset from guardrail 22 and associated first support post 24*a*. Block 26 is preferably disposed between guardrail 22 and the upper portion of support post 24*b*. Block 26 may be attached to or mounted on first side 25 of support post 24*b*. The dimensions and configuration of block 26 are selected to accommodate the desired offset between support post 24*b* and guardrail 22. As shown in FIG. 6, this offset results in the longitudinal axis of strut 90 extending at an acute angle relative to guardrail 22 when strut 90 is attached to posts 24*a* and 24*b*. An angle strut formed in accordance with teachings of the present invention may be satisfactorily used to accommodate either a right or left lateral offset relative to the associated guardrail.

An alternative configuration for installing angle strut 90 extending between first support post 24*a* and second support 24*b* is shown in FIG. 7. As best shown in FIG. 8, support block 94 is preferably disposed between angle 90 and first side 25 of second support post 24*b*. The dimensions of support block 94 are preferably selected to correspond with the dimensions of angle strut 90. For the embodiment of the present invention as shown in FIGS. 7 and 8, support block 94 will have a generally square cross section with dimensions of approximately three inches by three inches.

Bolt 44 preferably extends through an opening in second end 92 of strut 90, a corresponding opening in support block 94, openings in the portion of hollow tube 32 above ground level and a corresponding opening in second support post 24*b*. Nut 46 is preferably attached to bolt 44 to securely position angle strut 90 adjacent to hollow tube 32 and second support post 24*b*. Support block 94 allows installation of angle strut 90 with the L-shaped configuration facing away from the associated roadway similar to the position of angle strut 90 as shown in FIGS. 1–5 in connection with guardrail system 20.

For some applications a pair of angle struts 90 may be disposed between first support post 24*a* and second support post 24*b*. For example, highway guardrail end terminal assembly 30 as shown in FIG. 1 may be modified by installing respective support block 94 and second angle strut 90 on the side of foundation sleeve 32 adjacent to the associated roadway. The length of bolts 44 would have to be increased as compared the embodiment shown in FIG. 1.

Figures 9, 10:
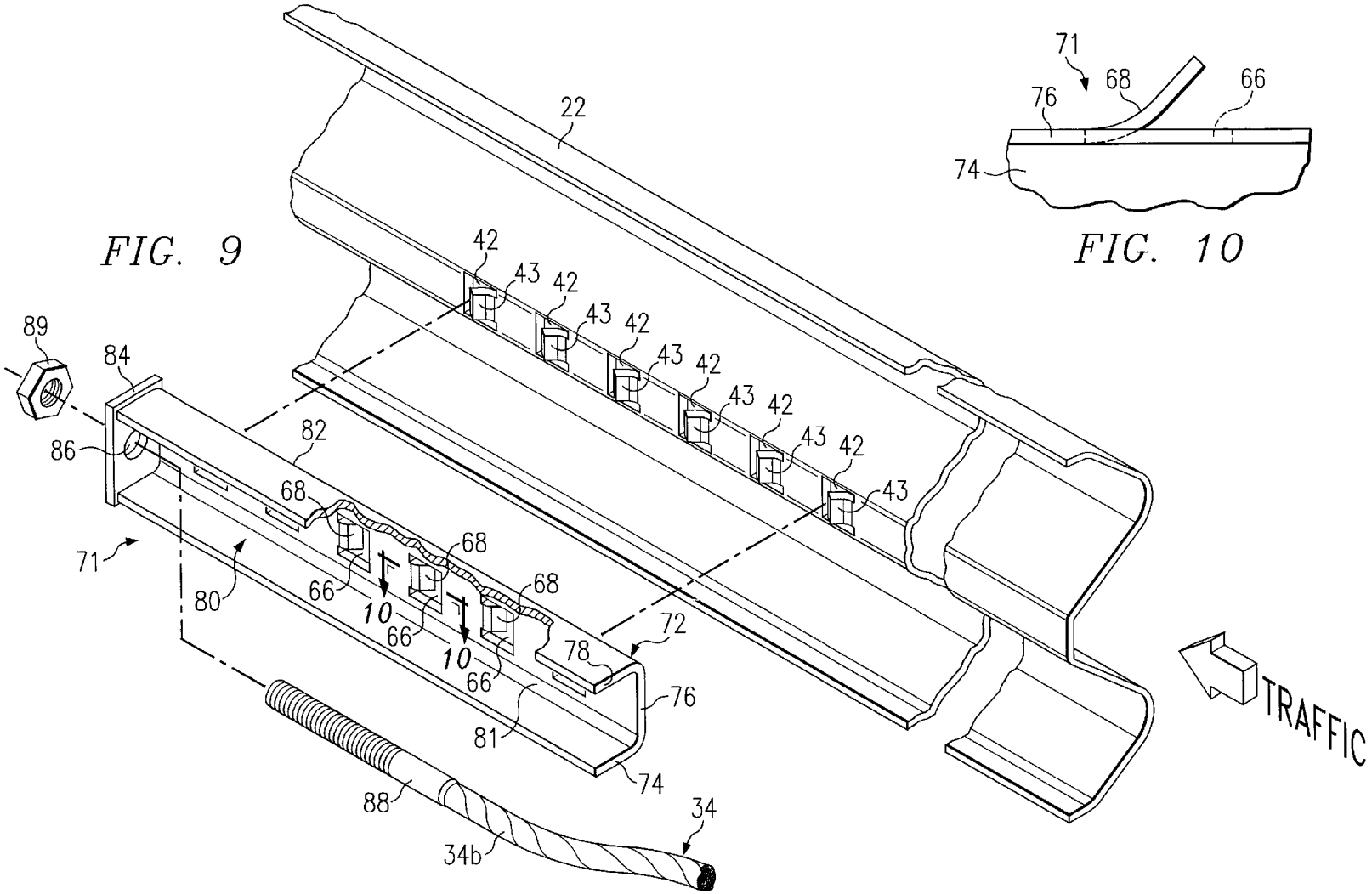
FIG. 9 is an enlarged, exploded drawing showing portions of a cable, a cable anchor bracket and associated guardrail which may be used with an angle strut incorporating teachings of the present invention.
FIG. 10 is an enlarged drawing in section with portions broken away taken along lines 10—10 of FIG. 9 showing one of the tabs formed in the cable anchor bracket of FIG. 9.
Figures 11, 12:
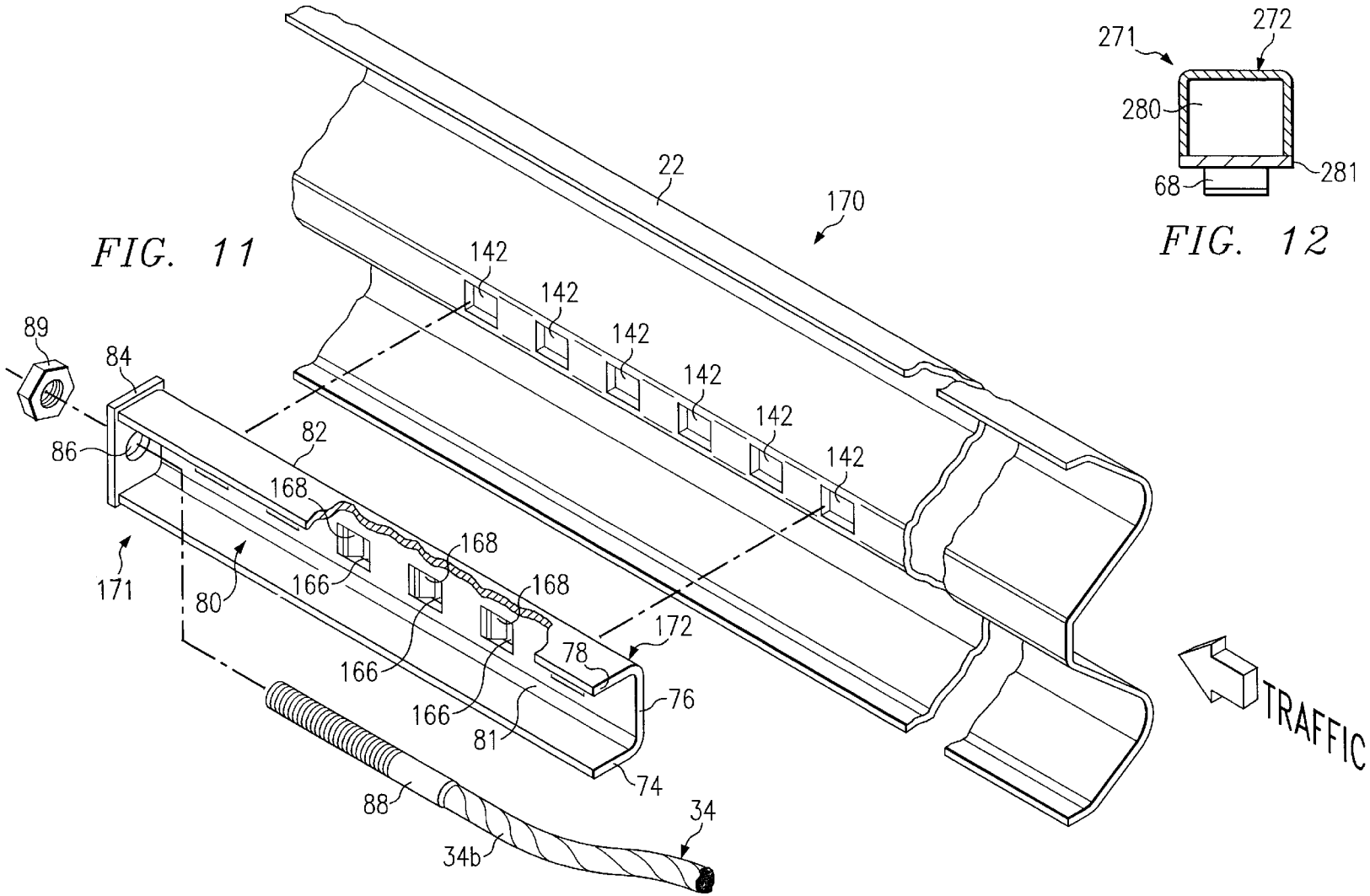
FIG. 11 is an enlarged, exploded drawing showing portions of another cable, cable anchor bracket and associated guardrail which may be used with an angle strut.
FIG. 12 is a drawing in section with portions broken away showing still another cable anchor bracket.
Figure 13:
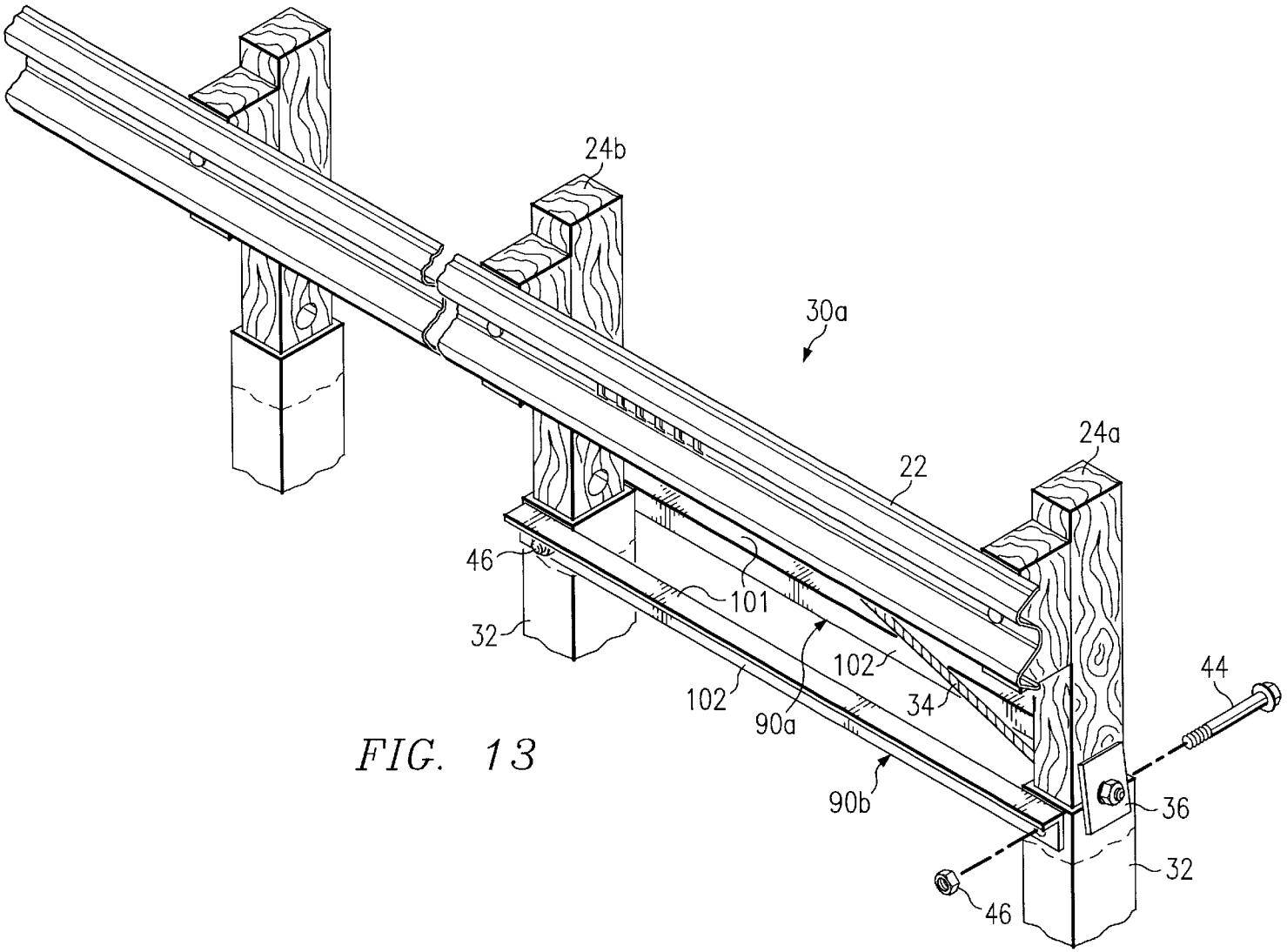
FIG. 13 is an isometric drawing with portions broken away showing a pair of angle struts disposed between a first support post and a second support post in accordance with teachings of the present invention.

As shown in more detail in FIGS. 9 and 11, second portion 34*b* of cable 34 may be disposed within and fastened to either cable anchor bracket 71 or 171. As shown in FIG. 9, cable anchor bracket 71 preferably includes elongated member 72 having a first side 74, second side 76 and a third side 78 which cooperate with each other to define cable receiving channel 80 having a generally open U-shaped cross section.

For one application, elongated member 72 may be fabricated from a single piece of generally rectangular sheet metal (not shown) by forming a first longitudinal bend 81 and a second longitudinal bend 82 extending approximately parallel with each other to provide first side 74, second side 76 and third side 78 of cable receiving channel 80. The resulting elongated member 72 provides cable receiving channel 80 with a generally U-shaped cross section and one open longitudinal side as shown in FIG. 9. The open longitudinal side allows second portion 34*b* of cable 34 to be readily disposed therein.

Plate 84 with opening 86 extending therethrough is preferably attached to one end of cable receiving channel 80. Threaded cable termination 88 provided on second portion 34*b* may be inserted through opening 86. Nut 89 is used with threaded cable termination 88 and plate 84 to fasten second portion 34*b* of cable 34 with cable anchor bracket 71.

A plurality of tabs 68 are preferably formed as an integral part of second side 76 of cable receiving channel 80. Each tab 68 preferably extends at an angle of approximately forty-five degrees (45°) relative to the exterior of elongated member 72. As shown in FIG. 9, tabs 68 may be formed by using conventional metal stamping techniques which result in a plurality of openings or partial cutouts 66 with respective tabs 68 extending therefrom. The width of each tab 68 is less than the width of the respective cutout 66.

Using similar metal working techniques, a plurality of apertures 42 and associated tabs 43 may be formed in the portion of guardrail 22 which will be disposed intermediate first post 24*a* and second post 24*b*. Tabs 43 preferably extend from guardrail 22 in a direction opposite from the flow of traffic and are formed at approximately the same forty-five degree (45°) angle as tabs 68 of cable anchor assembly 70. Also, tabs 43 may be formed with a width less than the associated aperture 42.

Tabs 68 and their respective openings 66 cooperate with corresponding tabs 43 and their respective apertures 42 to allow cable anchor bracket 71 and second portion 34*b* of cable 34 to be releasably anchored with guardrail 22. Nut 89 and threaded cable terminal 88 along with nut 38 may be tightened using conventional techniques to place the desired amount of tension on cable 34 and thus guardrail 22 during the installation of end terminal assembly 30.

Cable anchor bracket 171 incorporating another embodiment of the present invention is shown in FIG. 11. Cable anchor bracket 171 preferably includes elongated member 172 having a first side 74, second side 76, and a third side 78 which may be fabricated from a single piece of generally rectangular sheet metal as previously described with respect to elongated member 72 of cable anchor bracket 71.

Some of the differences between cable anchor bracket 71 and cable anchor bracket 171 include forming tabs 168 with essentially the same width as the associated cutout 166. As best shown in FIG. 9, the metal stamping techniques used to form tabs 68 provide a substantially relieved portion on each side of the respective tab 68. As best shown in FIG. 10, the metal stamping techniques associated with forming elongated member 172 result in each tab 168 having essentially the same width as the associated cutout 166. The resulting elongated member 172 provides cable receiving channel 80 having a generally U-shaped cross section with one open longitudinal side as previously described with respect to cable anchor bracket 71.

Cable anchor bracket 271 is shown in FIG. 12. Cable anchor bracket 271 includes cable receiving channel 280 which is defined in part by elongated member 272 and longitudinal plate 281. Cable receiving channel 280 has a generally hollow, rectangular cross section and is closed on all four longitudinal sides. Elongated member 272 may be formed from a single piece of sheet metal having a generally U-shaped cross section as previously described with respect to elongated members 72 and 172. Instead of forming tabs 68 as part of elongated member 272, tabs 68 may be formed as an integral part of longitudinal plate 281 using stamping or other appropriate techniques. Longitudinal plate 281 may then be attached to elongated member 272 to provide the desired closed, generally rectangular cross section shown in FIG. 12. One end (not shown) of cable anchor bracket 271 includes plate 84 and opening 86. The other end (not shown)

of cable anchor bracket 271 is preferably open to allow inserting second portion 34*b* of cable 34.

Portions of guardrail end terminal assembly 30*a* formed in accordance with teachings of the present invention. Guardrail end terminal assembly 30*a* is similar to previously described end terminal assembly 30*b* except for a pair of angle struts 90*a* and 90*b* disposed between first support post 24*a* and second support post 24*b*. Angle struts 90*a* and 90*b* may have the same characteristics and features as previously described for angle strut 90. Angle struts 90*a* and 90*b* are preferably installed below applicable height limits established by the American Association of State Highway and Transportation Officials (AASHTO).

Although the present invention and its advantages have been described in detail it should be understood that various changes, substitutions, and alterations can be made hereto without departing from the spirit and scope of the invention as defined by the following claims.

What is claimed is:

1. A highway guardrail end terminal assembly having at least a first support post and a second support post satisfactory for mounting a guardrail thereon comprising:

each support post having an elongated body with an upper portion and a lower portion;

the upper portion of each elongated body having a first end and the lower portion of each elongated body having a second end which may be installed adjacent to a roadway;

each support post having a first side disposed adjacent to the roadway and a second side disposed opposite from the roadway;

a guardrail attached to the first side of each support post and adjacent to the first end of each support post;

at least one angle extending between and attached to the first support post and the second support post;

a first mechanical fastener extending through a first end of the angle, a portion of a first hollow tube and the first support post;

a second mechanical fastener extending through a second end of the angle, a portion of a second hollow tube and the second support post; and the angle located on the second side of the first support post and the second side of the second support post.

2. The guardrail end terminal assembly of claim 1, further comprising each support post having a generally square cross section.

3. The guardrail end terminal assembly of claim 1, further comprising each support post having a generally circular cross section.

4. The guardrail end terminal assembly of claim 1, further comprising a pair of angles extending between and attached to the first support post and the second support post.

5. The guardrail end terminal assembly of claim 1, wherein the angle further comprises a cross section having dimensions of approximately three inches by three inches and a thickness of approximately one-fourth of an inch.

6. The guardrail end terminal assembly of claim 1, further comprising a second angle attached to the first side of the first support post and the first side of the second support post.

7. The guardrail end terminal assembly of claim 1 wherein the angle further comprises a hot rolled angle having a generally L-shaped cross section with dimensions of approximately three inches by three inches and a thickness of approximately one-fourth of an inch.

8. A roadway guardrail system, comprising:

at least a first support post and a second support post with each support post having an upper portion and a lower portion;

each support post having a first side disposed adjacent to an associated roadway and a second side opposite from the associated roadway;

the upper portion of each support post having an upper end and the lower portion of each support post having a lower end;

a guardrail coupled to the first side of each support post adjacent to the upper end thereof;

at least a first hollow tube and a second hollow tube disposed adjacent to the roadway;

the lower portion of each support post respectively disposed in one of the hollow tubes;

a first angle strut extending between the first support post and the second support post;

the first angle strut having a first end and a second end;

a first mechanical fastener extending through the first end of the first angle strut, a portion of the first hollow tube and the first support post;

a second mechanical fastener extending through the second end of the first angle strut, a portion of the second hollow tube and the second support post;

a kinetic energy absorbing assembly mounted on one end of the guardrail facing oncoming traffic; and the first angle strut located on only the first side of the first support post and the first side of the second support post or located on only the second side of the first support post and the second side of the second support post.

9. The roadway guardrail system of claim 8 wherein the first and second mechanical fasteners further comprise:

bolts which extend through appropriately sized openings formed in the first angle strut, the respective portions of the hollow tubes and the respective support posts; and a respective nut attached to each bolt.

10. The roadway guardrail system of claim 8 further comprising a block disposed between the guardrail and the first side of the second support post to form a lateral offset between the guardrail and the second support post.

11. The roadway guardrail system of claim 8 wherein the first angle strut further comprises a hot rolled angle with a generally L-shaped cross section.

12. The roadway guardrail system of claim 8 further comprising a second angle strut extending between the first support post and the second support post.

13. The highway guardrail system of claim 8 further comprising the guardrail having a W beam configuration.

14. A roadway guardrail system, comprising:

at least a first support post and a second support post with each support post having an upper portion and a lower portion;

each support post having a first side disposed adjacent to an associated roadway and a second side opposite from the associated roadway;

the upper portion of each support post having an upper end and the lower portion of each support post having a lower end;

a guardrail coupled to the first side of each support post adjacent to the upper end thereof;

an angle strut extending between the first support post and the second support post;

the angle strut having a first end and a second end;

a first mechanical fastener extending through the first end of the angle strut and the first support post;

a second mechanical fastener extending through the second end of the angle strut and the second support post;

a kinetic energy absorbing assembly mounted on one end of the guardrail facing oncoming traffic;

a block disposed between the guardrail and the first side of the second support post to form a lateral offset between the guardrail and the second support post;

the angle strut attached to the second side of the first support post;

the angle strut attached to the first side of the second support post;

a spacer block disposed between the angle strut and the first side of the second support post; and the second mechanical fastener extending through the second end of the angle strut, the spacer block and the second support post.

15. A roadway guardrail system, comprising:

at least a first support post and a second support post with each support post having an upper portion and a lower portion;

each support post having a first side disposed adjacent to an associated roadway and a second side opposite from the associated roadway;

the upper portion of each support post having an upper end and the lower portion of each support post having a lower end;

a guardrail coupled to the first side of each support post adjacent to the upper end thereof;

at least a first hollow tube and a second hollow tube disposed adjacent to the roadway;

the lower portion of each support post respectively disposed in one of the hollow tubes;

an angle strut extending between the first support post and the second support post;

the angle strut having a first end and a second end;

a first mechanical fastener extending through the first end of the angle strut, a portion of the first hollow tube and the first support post;

a second mechanical fastener extending through the second end of the angle strut, a portion of the second hollow tube and the second support post;

a kinetic energy absorbing assembly mounted on one end of the guardrail facing oncoming traffic; and the first end of the angle strut attached to only the second side of the first support post and the second end of the angle strut attached to only the second side of the second support post.

16. A roadway guardrail system, comprising:

at least a first support post and a second support post with each support post having an upper portion and a lower portion;

each support post having a first side disposed adjacent to an associated roadway and a second side opposite from the associate roadway;

the upper portion of each support post having an upper end and the lower portion of each support post having a lower end;

a guardrail coupled to the first side of each support post adjacent to the upper end thereof;

at least a first hollow tube and a second hollow tube disposed adjacent to the roadway;

the lower portion of each support post respectively disposed in one of the hollow tubes;

a first angle strut extending between the first support post and the second support post;

the first angle strut having a first end and a second end;

a first mechanical fastener extending through the first end of the first angle strut, a portion of the first hollow tube and the first support post;

a second mechanical fastener extending through the second end of the first angle strut, a portion of the second hollow tube and a second support post;

a kinetic energy absorbing assembly mounted on one end of the guardrail facing oncoming traffic;

a second angle strut extending between the first support post and the second support post;

the first mechanical fastener and the second mechanical fastener extending through both angle struts, portions of the respective hollow tubes and the respective support posts; and the first angle strut located on only the first side of the first support post and the first side of the second support post.

17. A highway guardrail end terminal assembly having at least a first support post and a second support post satisfactory for mounting a guardrail thereon comprising:

each support post having an upper portion and a lower portion along with a first side disposed adjacent to an associated roadway and a second side opposite from the associated roadway;

the upper portion of each support post having an upper end and the lower portion of each support post having a lower end;

at least a first hollow tube and a second hollow tube disposed adjacent to the roadway;

the lower portion of each support post respectively disposed in one of the hollow tubes;

an angle having a generally L-shaped cross section extending between the first support post and the second support post;

the angle having a first end and a second end;

a first mechanical fastener extending through the first end of the angle, portions of the first hollow tube and the first support post;

a second mechanical fastener extending through the second end of the angle, portions of the second hollow tube and the second support post;

the angle located on either the first side or the second side of the first support post and located on either the first side or the second side of the second support post.

18. The guardrail end terminal assembly of claim 17 wherein the angle further comprises a cross section having dimensions of approximately three inches by three inches with a thickness of approximately one-fourth of an inch.

19. The guardrail end terminal assembly of claim 17 further comprising the angle-attached to the first support post and the second support post with the generally L-shaped cross section facing away from the adjacent roadway.

20. A highway guardrail end terminal assembly having at least a first support post and a second support post satisfactory for mounting a guardrail thereon comprising:

each support post having an elongated body with an upper portion and a lower portion;

the upper portion of the elongated body having a first end and the lower portion of the elongated body having a second end which may be installed adjacent to a roadway;

each support post having a first side disposed adjacent to the roadway and a second side disposed opposite from the roadway;

a guardrail attached to the first side of each support post and adjacent to the first end of each support post;

at least one angle extending between and attached to the first support post and the second support post;

a first mechanical fastener extending through a first end of the angle and the first support post;

a second mechanical fastener extending through a second end of the angle and the second support post; and the angle located on either the first side or the second side of the first post and located on either the first side or the second side of the second post.

* * * * *